US009127442B1

(12) United States Patent
Underwood

(10) Patent No.: US 9,127,442 B1
(45) Date of Patent: Sep. 8, 2015

(54) BUCKET, BREAKER, AND GRIPPING APPARATUS FOR AN EXCAVATOR BOOM STICK

(71) Applicant: Lowell Underwood, Prosper, TX (US)

(72) Inventor: Lowell Underwood, Prosper, TX (US)

( * ) Notice: Subject to any disclaimer, the term of this patent is extended or adjusted under 35 U.S.C. 154(b) by 0 days.

(21) Appl. No.: 14/259,121

(22) Filed: Apr. 22, 2014

(51) Int. Cl.
*E02F 3/96* (2006.01)

(52) U.S. Cl.
CPC . *E02F 3/964* (2013.01); *E02F 3/96* (2013.01); *E02F 3/966* (2013.01)

(58) Field of Classification Search
USPC ..... 37/403, 404, 406, 903
IPC ..... E02F 3/96,3/963, 3/966
See application file for complete search history.

(56) References Cited

U.S. PATENT DOCUMENTS

| | | | | |
|---|---|---|---|---|
| 3,865,013 | A | 2/1975 | Mastaj | |
| 4,070,772 | A | 1/1978 | Montomura et al. | |
| 4,087,010 | A * | 5/1978 | Stormon | 414/722 |
| 4,100,688 | A | 7/1978 | Grist | |
| 4,466,494 | A * | 8/1984 | Hanson | 173/46 |
| 4,810,162 | A | 3/1989 | Foster | |
| 4,869,002 | A | 9/1989 | Glenn | |
| 5,277,264 | A | 1/1994 | Song et al. | |
| 5,373,652 | A | 12/1994 | Olsson | |
| 5,451,135 | A | 9/1995 | Schempf et al. | |
| 5,549,440 | A | 8/1996 | Cholakon et al. | |
| 5,689,905 | A | 11/1997 | Ibusuki | |
| 6,085,446 | A | 7/2000 | Posch | |
| 6,120,237 | A | 9/2000 | Cummings et al. | |
| 6,269,560 | B1 | 8/2001 | Pratt | |
| 6,430,849 | B1 | 8/2002 | Underwood | |
| 6,751,896 | B2 | 6/2004 | Underwood | |
| 7,117,618 | B2 | 10/2006 | Underwood | |
| 7,257,910 | B2 | 8/2007 | Underwood | |

OTHER PUBLICATIONS

Komatsu Mini-Excavator, PC03-2F brochure sheets (3 pp.), dated Apr. 2000.

* cited by examiner

*Primary Examiner* — Gary Hartmann
(74) *Attorney, Agent, or Firm* — John G. Fischer, Esq.; Scheef & Stone, L.L.P.

(57) ABSTRACT

An excavating machine, representatively a tracked excavator, has a boom stick portion on which an excavating bucket and a gripper assembly mounted. A hydraulic breaker is protectively mounted inside the breaker assembly and extends outward therefrom. The bucket may be operated independently of the gripper assembly for digging operations. The gripper assembly may be positioned independently of the bucket and the breaker actuated for refusal material-breaking operations. The bucket and the gripper may be cooperatively operated to perform removal operations. The same excavating machine can be used for digging, gripping, and breaking operations without a tool change.

9 Claims, 6 Drawing Sheets

BUCKET, BREAKER, AND GRIPPING APPARATUS FOR AN EXCAVATOR BOOM STICK

BACKGROUND OF THE INVENTION

1. Technical Field

The present invention generally relates to a material handling apparatus and, in an embodiment thereof, more particularly relates to an excavating apparatus, representatively a tracked excavator, having operatively attached to the stick portion of its boom a specially designed combination bucket, breaker, and gripping apparatus which uniquely permits the excavator operator to selectively carry out multiple operations, including digging, breaking refusal material, and object grip and lift tasks without having to change out equipment on the stick.

2. Description of Related Art

Large scale earth excavation operations are typically performed using a powered excavating apparatus, such as a tracked excavator, having an articulated, hydraulically pivotable boom structure with an elongated, pivotal outer end portion commonly referred to as a "stick". Secured to the outer end of the stick is an excavating bucket, which is hydraulically pivotable relative to the stick between "closed" and "open" positions. By pivotally manipulating the stick, with the bucket swung to a selected operating position, the excavator operator uses the bucket to forcibly dig into the ground, scoop up a quantity of dirt, and move the scooped up dirt quantity to another location, such as into the bed of an appropriately positioned dump truck.

A first common occurrence during conventional digging operations is that the bucket strikes refusal material (in excavation parlance, a material which "refuses" to be dug up) such as rock which simply cannot be broken and scooped up by the bucket. When this occurs, it is typical practice to stop the digging operation, remove the bucket from the stick, and install a hydraulically operated "breaker" on the outer end of the stick in place of the removed bucket. The breaker has, on its outer end, an oscillating tool portion which rapidly hammers the refusal material in a manner breaking it up into portions which can be subsequently dug up. After the breaker has been utilized to break up the refusal material, the operator removes the breaker from the stick, replaces the breaker with the previously removed bucket, and resumes the digging operation with the bucket.

While this procedure is easy to describe, it is a difficult, laborious and time-consuming task for the operator to actually carry out due to the great size and weight of both the bucket and breaker which must be attached to and then removed from the stick, and the necessity for the operator to climb into and out of the high cab area of the excavator (often in inclement weather) to effect each bucket and breaker changeout on the stick. This sequence of bucket/breaker/bucket changeout, of course, must be laboriously repeated each time a significant refusal area is encountered in the overall digging process.

A previously utilized alternative to this single excavator sequence is to provide two excavators for each digging project—one excavator having a bucket attached to its boom stick, and the second excavator having a breaker attached to its boom stick. When the bucket-equipped excavator encounters refusal material during the digging process, it is moved away from the digging site, and the operator climbs down from the bucket-equipped excavator, walks over to and climbs up into the breaker-equipped excavator, drives the breaker-equipped excavator to the digging site, and breaks up the encountered refusal material. Reversing the process, the operator then switches to the bucket-equipped excavator and resumes the digging process to scoop up the now broken-up refusal material.

While this digging/breaking technique is easier on the operator, it is necessary to dedicate two large and costly excavators to a given digging task, thereby substantially increasing the total cost of a given excavation. A modification of this technique is to use two operators one to operate the bucket-equipped excavator, and one to operate the breaker-equipped excavator. This, of course, undesirably increases both the manpower and equipment cost for a given excavation project.

A second common occurrence during conventional digging operations is that removal objects (objects that need to be "removed" or relocated), such as large surface rocks, felled trees, construction debris, and other objects that do not fit into the bucket, need to be removed. When this occurs, it is typical practice to use a specialized excavator that is equipped with a static or hydraulically operated "thumb." The bucket can be used to position the removal object between the bucket and the thumb for gripping the removal object, lifting and relocating it.

An additional limitation to this configuration is that if the excavator is fitted with a conventional thumb, the thumb presents a second obstacle to the attachment of the breaker. In this instance, a second excavator having a breaker attached to its boom stick is more appropriately required for the digging project. When the bucket and thumb-equipped excavator encounters refusal material during the digging process, it is moved away from the digging site, and the operator climbs down from the bucket-equipped excavator, walks over to and climbs up into the breaker-equipped excavator, drives the breaker-equipped excavator to the digging site, and breaks up the encountered refusal material. Reversing the process, the operator then switches to the bucket and thumb-equipped excavator and resumes the digging process to scoop up the now broken-up refusal material.

Once again, it is necessary to dedicate two large and costly excavators to a given digging task, thereby substantially increasing the total cost of a given excavation project.

An attempt to solve this problem is disclosed in U.S. Pat. No. 6,085,446 and U.S. Pat. No. 4,100,688 for an excavating machine having a motorized milling tool attached to the back of the bucket. A primary disadvantage of these devices is complexity, cost, and reliability. Another disadvantage is the weight that must be continuously carried by the bucket. The additional weight substantially reduces the carrying capacity and mobility of the bucket. Another disadvantage to the device of U.S. Pat. No. 6,085,446 is that the back of the bucket cannot be used to smooth or pad the soil, as is a well-known practice in the industry. Another disadvantage is that surface rock is not subject to an overburden pressure, so it generally fails faster under compression and impact forces than by the shearing forces of a scrapping and gouging rotary drilling tool.

Another attempt to solve this problem is disclosed in U.S. Pat. No. 4,070,772 for an excavating machine having a hydraulic breaker housed inside, or on top of, the boom stick. A primary disadvantage of this device is that it is extremely complex and expensive. Another disadvantage of this device is that it cannot be retrofit to existing excavators. Another disadvantage of this device is that the size of the breaker is limited. Another disadvantage of this device is that the bucket must be fully stowed to access the breaker and vice versa, making simultaneous operation impractical.

A more recent attempt to solve this problem is disclosed in U.S. Pat. No. 5,689,905 for another excavating machine having a hydraulic breaker housed inside, or on top of, the boom stick. In this device, the cutting tool portion (such as a chisel) of the breaker is removed when not in use. A primary disadvantage of this device is that it fails to permit immediate, unassisted switching from breaker to bucket, and thus simultaneous operation is impossible. Another disadvantage of this device is that it requires manual handling of the extremely heavy chisel tool each time the operator desires to convert to a breaker or bucket operation. Another disadvantage of this device is that it is extremely complex and expensive. Another disadvantage of this device is that it cannot be retrofit to existing excavators.

More recently, a commercially successful solution to at least part of this problem is disclosed in U.S. Pat. No. 6,430,849, U.S. Pat. No. 6,751,896, U.S. Pat. No. 7,117,618 and U.S. Pat. No. 7,257,910 (collectively, "the '849 patent family"). The '849 patent family discloses the Bayonet® Breaker System which provides an excavating machine known as a back-hoe with a specially designed pivotable boom stick assembly that includes a boom stick having first and second excavating tools secured thereto for movement relative to the boom stick. The first excavating tool is an excavating bucket secured to the boom stick for pivotal movement relative thereto between a first position and a second position, and the second tool is a breaker secured to the boom stick for pivotal movement relative thereto between a stowed position and an operative position.

As described in the '849 patent family, the bucket is operable when the breaker is in its stowed position. The bucket is movable by the drive apparatus independent of the breaker, to perform a digging operation. The breaker is operable when the bucket is in a first "stowed" position, which is away from the deployed position of the breaker to prevent contact and interference. The breaker is movable by the drive apparatus independent of the bucket, to perform a breaking operation. Accordingly, the excavating machine may be advantageously utilized to perform both digging and breaking operations without equipment change-out on the boom stick.

However, this solution fails to solve the need for gripping removal objects. Central to the inventions of the '849 patent family is the avoidance of contact and interference of the bucket and the breaker during operation, the independence of their function and operation, and the remote positions provided for allowing independent operation. This is necessary because operating the bucket against the breaker is well-known in the industry to destroy the breaker housing and/or the breaker deployment cylinder.

Another disadvantage is that the '849 patents disclose a hydraulic control circuitry operable to selectively route hydraulic fluid through the hydraulic flow circuit to (1) a first portion of the drive apparatus associated with the bucket, or (2) a second portion of the drive apparatus associated with the breaker. This may prevent interference of the bucket with the breaker, but it is undesirable for a gripping function that benefits from simultaneous operation of the breaker deployment cylinder and the bucket.

The '618 patent suggests using the bucket against a free swinging and unpowered breaker for the purpose of lifting the breaker from a gravity deployed position back into a latched stowed position. This cylinder-less low cost alternative is now known to be unworkable as contact with even an unpowered breaker assembly destroys the breaker housing, and none have ever been made. Further, it is universally found necessary to have independent control over positioning of the breaker. Thus all workable configurations require a lower powered breaker deployment cylinder that is subject to destruction from the crushing force of the much higher powered hydraulic cylinder of the bucket.

The present invention contradicts the core principals of the prior art and practice by providing a combined bucket-gripper-breaker assembly on the end of an otherwise conventional excavator. In this invention, a gripper assembly is constructed around the breaker. The hydraulically powered gripper is then operated in concert with the bucket, intentionally placing the hydraulic power of the bucket and gripper assembly into operable positions of conflict. The reinforced structure of the gripper assembly is not damaged by the force. The gripper's serrated edges grip the removal object. To prevent overload and destruction of the gripper assembly deployment cylinder, a relief valve and accumulator are provided in the gripper's actuator line. Overloading by the bucket activates the relief valve, allowing hydraulic fluid to pass to the accumulator and causing retraction of the gripper, but avoiding destruction of the cylinder. In this manner, the additional functionality of gripping and lifting is provided to the excavating machine. This permits the use of the excavator to grip and lift material excavated by the breaker and bucket that might otherwise be unmovable or difficult to move with the bucket alone.

SUMMARY OF THE INVENTION

In carrying out principles of the present invention, in accordance with one embodiment thereof, an excavating machine, representatively a tracked excavator, is provided with a specially designed pivotable boom stick assembly that includes a boom stick having first, second, and third excavating tools secured thereto for movement relative to the boom stick. Illustratively, the first excavating tool is an excavating bucket secured to the boom stick for pivotal movement relative thereto between a first position and a second position, and the second tool is a gripper secured to the underside of the boom stick for pivotal movement relative thereto between a stowed position and an operative position. The third tool is a breaker secured inside the housing of the gripper and extending therefrom.

The bucket, when the breaker is in its stowed position, is movable by the drive apparatus to the second bucket position and is useable in conjunction with the boom stick, and independently of the breaker, to perform a digging operation. The breaker, when the bucket is in its first position, is movable by the drive apparatus to the breaker's operative position and is useable in conjunction with the boom stick, and independently of the bucket, to perform a breaking operation.

Accordingly, the excavating machine may be advantageously utilized to perform digging, gripping, and breaking operations without equipment changeout on the boom stick.

In one embodiment of the present invention, a boom stick assembly for use on an excavating machine is provided comprising a boom stick having a lower end, a top side, and an underside. A bucket is secured to a lower end of the boom stick for pivotal movement relative thereto. A gripper is pivotally connected to the lower end and underside of the boom stick for pivotal movement relative thereto. A breaker is located inside the gripper with its chisel extending outward from it. The bucket is movable between an extended position and a retracted position to perform a digging operation or a gripping operation. The gripper is movable between an extended position and a retracted position to perform a gripping operation in cooperation with the bucket. The gripper is extendable and retractable to position the breaker in relationship to refusal material targeted for breaking.

The breaker is hydraulically operable to perform a breaking operation. A first hydraulic cylinder is attached to the topside of the boom stick, and is operable to control movement of the bucket independent of the breaker assembly. A second hydraulic cylinder is attached to the underside of the boom stick, and is operable to control movement of the gripper independent of the bucket. A relief valve and accumulator are connected to the second hydraulic cylinder to permit compression of the second cylinder when the second cylinder is subjected to compressive force transferred from the first hydraulic cylinder that exceed a limit of the relief valve.

In another embodiment, the gripper further comprises a mounting plate attachable to an underside of the boom stick. A latch is affixed to the mounting plate. A housing assembly is pivotally connected to the mounting plate and has a boom side and an off-boom side. A gripper engagement structure is provided on the off-boom side of the housing. A strike is mounted to the boom side of the housing and is engagable with the latch for securing the gripper in a retracted position next to the boom stick. The hydraulically operable breaker is secured inside the housing and extends beyond the breaker.

In another embodiment, the first and second hydraulic cylinders are operable simultaneously. In another embodiment, the engagement surfaces extend to the pivotal connection of the housing to the lower end of the boom stick.

In another embodiment, the engagement surface is made of a wear resistant hardened steel. In another embodiment, the engagement surface is made of a wear resistant material welded to the off-boom edge of the housing.

In another embodiment, a reinforcement plate is connected to the housing, and a secondary engagement surface is provided on the reinforcement plate. In another embodiment, retraction of the bucket by force applied by the first cylinder is resisted by an opposing force applied by the second cylinder. In another embodiment, the excavating machine is a tracked excavator.

The advantage of the disclosed embodiments is that they provide additional and critical utility to a single excavating machine. Specifically, the excavator operator may uniquely and selectively carry out multiple operations, including digging, breaking refusal material, and object grip and lift tasks without having to change out equipment on the stick, and without the need for a second excavating machine.

DETAILED DESCRIPTION OF THE INVENTION

Figure 1:
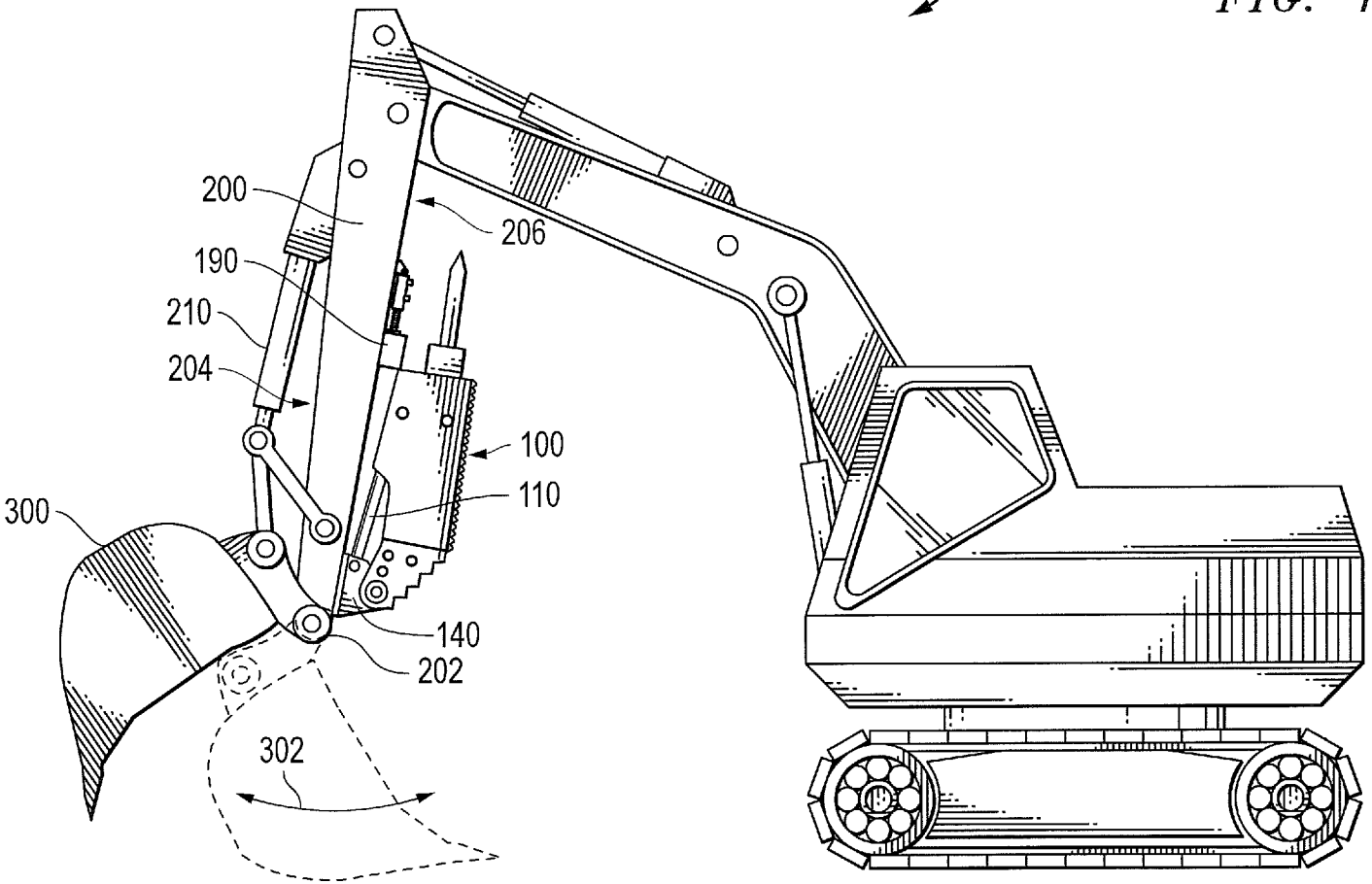
FIG. 1 is a simplified, side view of a representative excavating machine having a bucket, gripper, and breaker combination, illustrating the variable positioning available for a bucket while the gripper and breaker are in the stowed position.

Refer now to the drawings wherein depicted elements are, for the sake of clarity, not necessarily shown to scale and wherein like or similar elements are designated by the same reference numeral through the several views.

Figure 2:
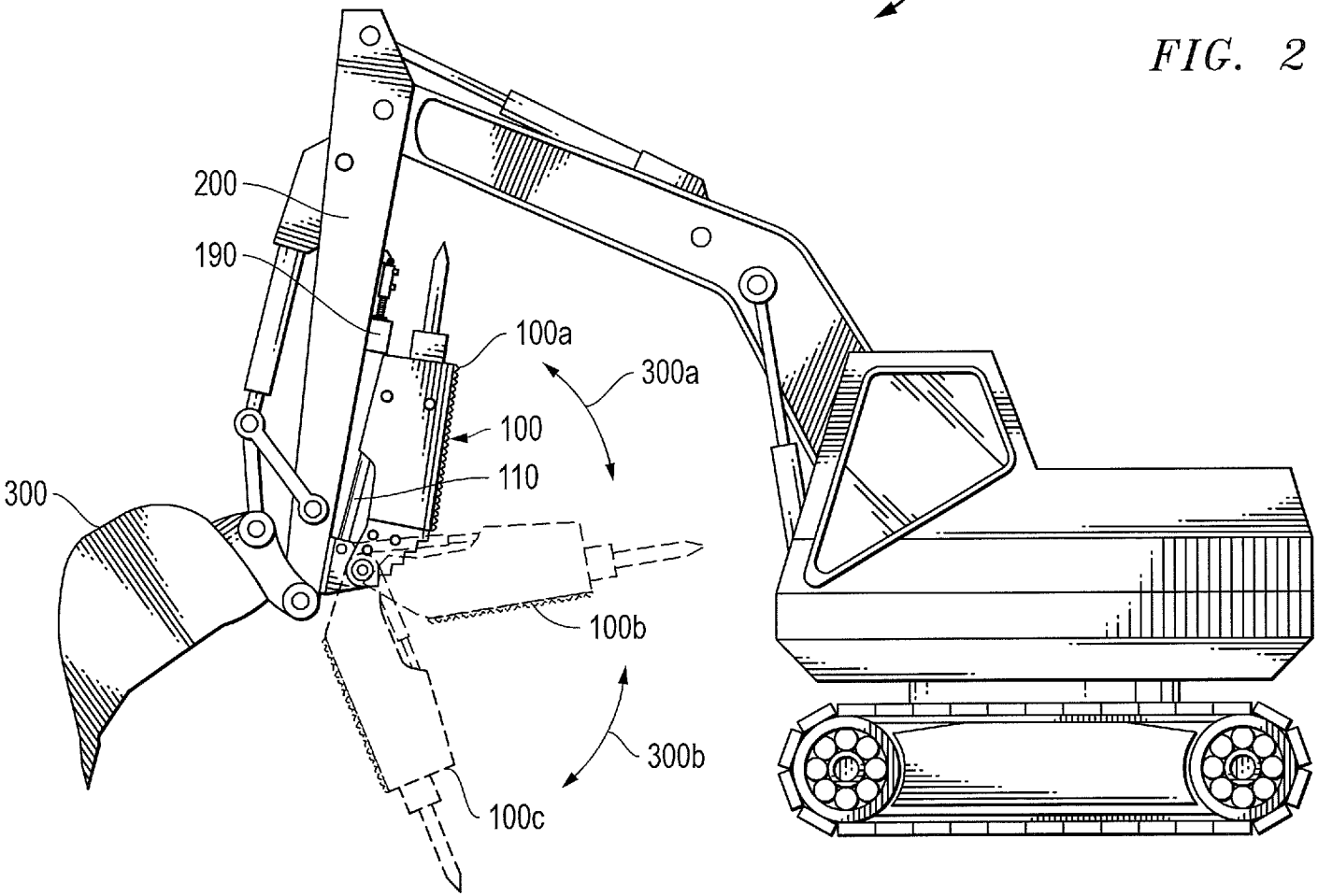
FIG. 2 is view of the excavating machine of FIG. 1, illustrating the variable positioning of the gripper and breaker while the bucket is in the stowed position.

Referring to FIGS. 1 and 2, a tracked-excavator 10 in accordance with an embodiment of the present invention is disclosed. Excavator 10 has a boom stick 200, which has a lower end 202, a topside 204, and an underside 206. A bucket 300 is pivotally mounted on boom stick 200 at the lower end 202. A first hydraulic cylinder 210 is pivotally attached at one end to the topside 204 of boom stick 200. First hydraulic cylinder 210 or other actuator is pivotally connected at its other end to bucket 300 to cause bucket 300 to move between a retracted position 300*a* and an extended position 300*b* as shown by arrow in FIG. 1.

A gripper assembly 100 is pivotally mounted to underside 206 of lower end 202 of boom stick 200. In the illustrated embodiment, gripper assembly 100 is pivotally attached to a first pivot 102 on a bracket 140. In one embodiment, first pivot 102 is a bifurcated pivot. A second hydraulic cylinder 110 or other actuator is pivotally attached at one end to second pivot 104 on bracket 140. Second cylinder 110 is pivotally attached at its other end to a third pivot 106 on gripper assembly 100. In the illustrated embodiment, the distance between first pivot 102 and second pivot 104 is advantageously less than the distance between first pivot 102 and third pivot 106.

A relief valve and accumulator (not shown) are connected to second cylinder 110 to permit compression of second cylinder 110 when second cylinder 110 is subjected to a compressive force that exceeds its limit. A latch 190 is located on underside 206 of boom stick 200. When gripper assembly 100 is in a retracted or stowed position 100*a*, latch 190 engages strike 132 (best seen in FIG. 5) so that gripper assembly 100 remains in the retracted or stowed position. First cylinder 110 is used to move gripper assembly 100 between retracted position 100*a*, a partially-extended position 100*b*, a fully-extended position 100*c*, or any position in-between as shown by arrows in FIG. 2. Gripper assembly 100 also includes a breaker 180, which may be used to break apart any refusal material. Breaker 100 is mounted inside gripper assembly 100 where it is protected from contact with removal objects and contact with bucket 300. A chisel of breaker 100 extends beyond gripper assembly 100.

Figure 3:
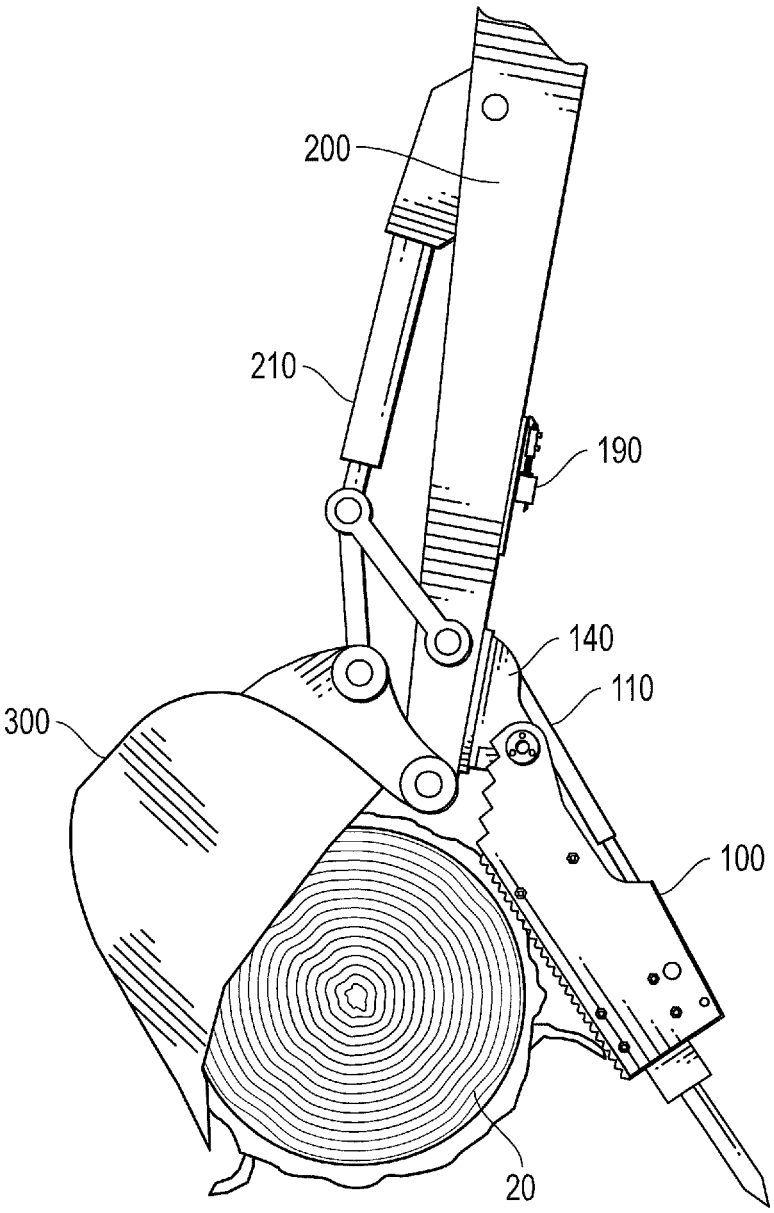
FIG. 3 is view of the excavating machine of FIGS. 1 and 2, illustrating use of the gripper and bucket to grip and relocate a removal object (rock).

Referring to FIG. 3, the function capability of gripper assembly 100 in combination with bucket 300 is illustrated by their gripping a removal object 20 (e.g., tree stump shown). First cylinder 210 is activated to cause bucket 300 to move into the extend position and into direct contact against the removal object 20. Second hydraulic cylinder 110 is also activated to cause gripper 100 to move into extended position 100*b* and into direct contact with the other side of removal object 20 and exerting force from the generally opposite direction as the force being applied by bucket 300, thus gripping removal object 20. First and second hydraulic cylinders 210 and 110 may be operated independently. In one embodiment, first and second hydraulic cylinders 210 and 110 may be operated simultaneously. Gripper assembly 100 includes a serrated or toothed surface (described below) for increasing friction between the gripper assembly 100 and any removal object 20 being gripped. Once gripped, removal object 20 can be relocated to another location.

Figure 4:
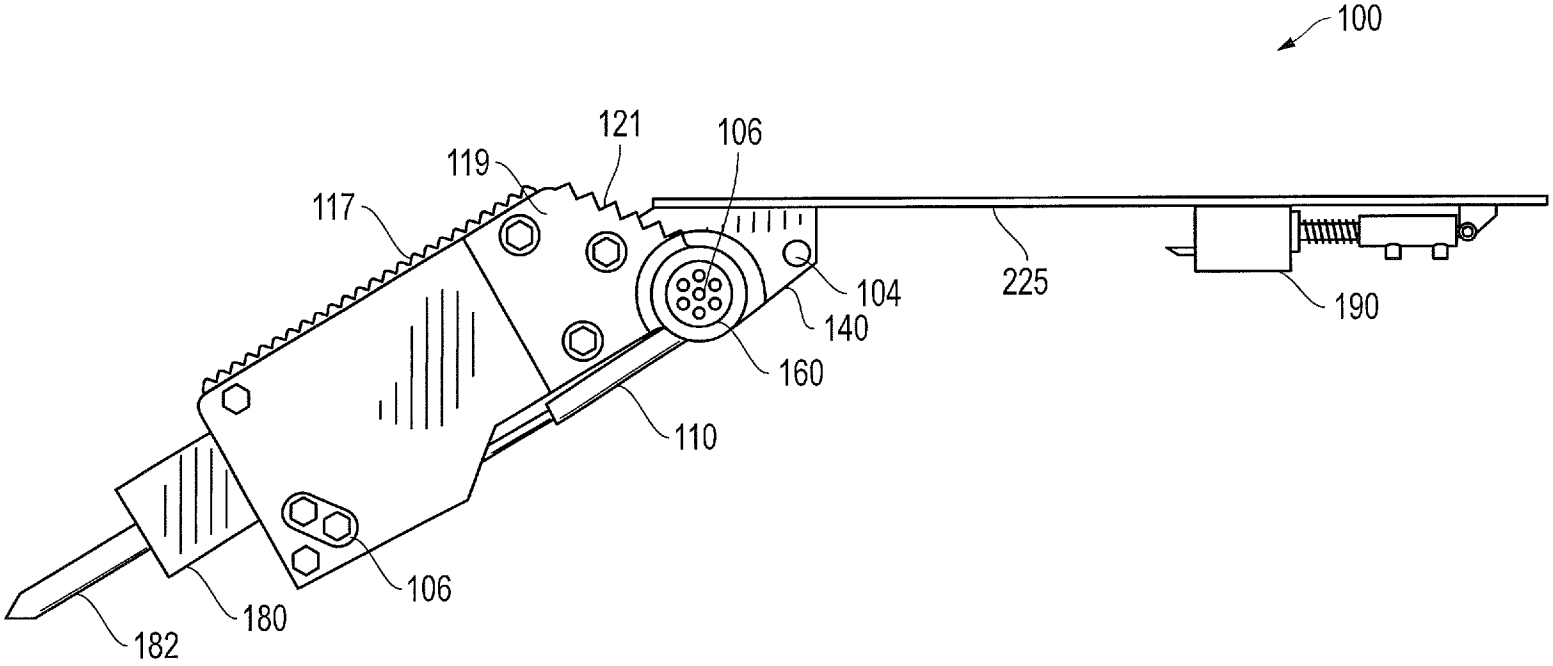
FIG. 4 is a side view of an embodiment of the gripper and breaker assembly.

FIG. 4 is an isometric view of an embodiment of a mounting system. FIG. 4 illustrates bracket 140 and latch 190 of FIG. 1 attached to a plate 225 by welding or other similarly secure means. In this embodiment, latch 190 can be located in proper alignment with bracket 140 and gripper assembly 100 on plate 225 prior to installation on excavating machine 10. Plate 225 can then be attached to boom stick 200 in proper alignment as provided by alignment of plate 225 with underside 206 of boom stick 200. Optionally, gripper assembly 100, first cylinder 210 bracket 140 and latch 190 are mounted directly to underside 206 of boom stick 200 without use of plate 225. Other embodiment options disclosed herein are independent of whether plate 225 is used or not, and the various embodiments of the invention are not dependent upon the attachment option illustrated in FIG. 4.

In the embodiments shown in FIGS. 1-4, bracket 140 is illustrated as attached to boom stick 200 (optionally by plate 225). One end of first cylinder 110 is pivotally coupled to bracket 140. The opposite end of first cylinder 110 is pivotally coupled to third pivot 106 between a first body section 112 and a second body section 114 (not shown) of gripper assembly 100. Body sections 112 and 114 pivotally couple gripper assembly 100 to first pivot 102. First pivot 102 may be comprised of a pair of coaxial trunnions 160 located on bracket 140.

Figure 5:
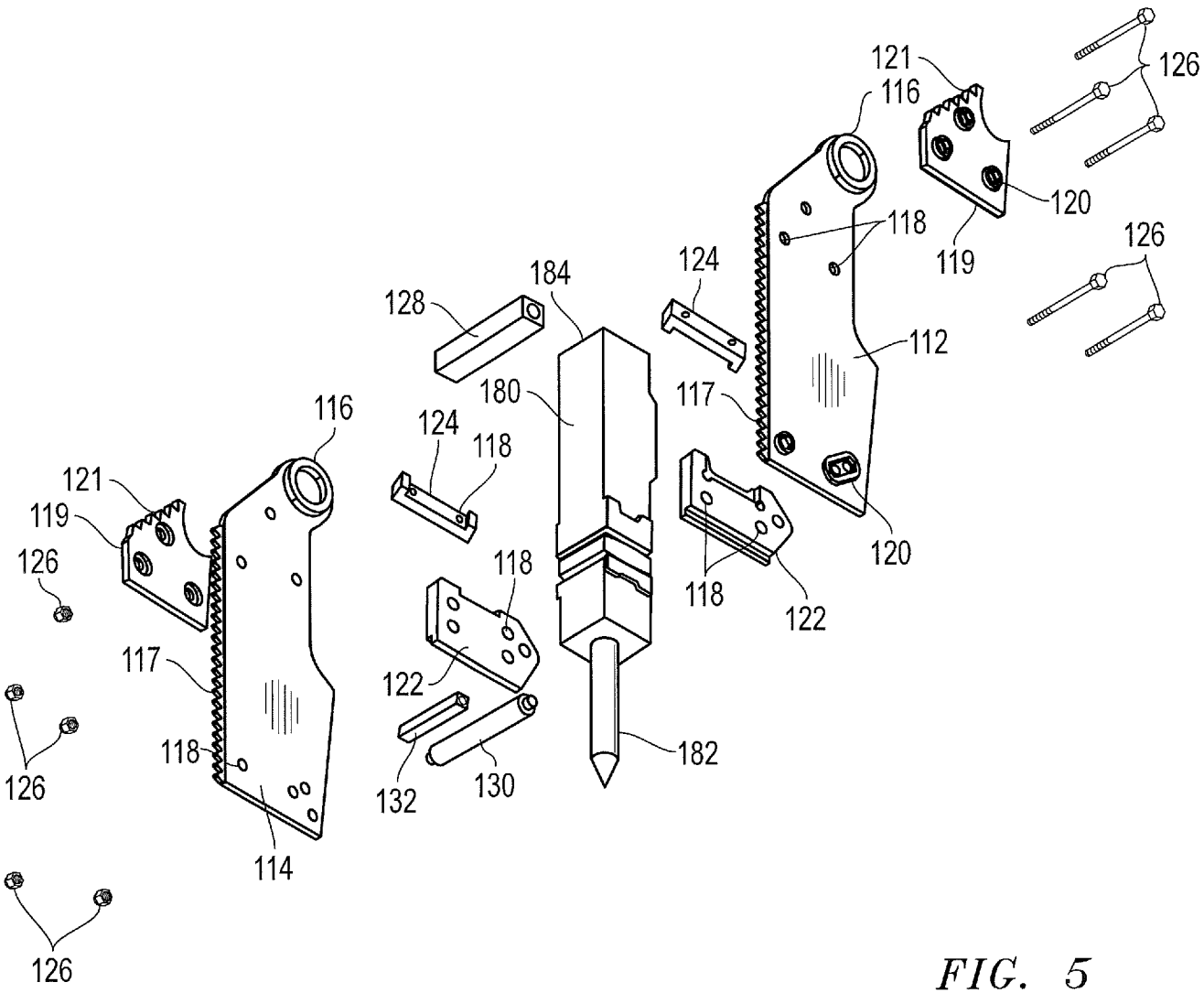
FIG. 5 is an exploded view of an embodiment of the gripper and breaker assembly of the present invention.

FIG. 5 is an exploded view of an embodiment of gripper assembly 100. Gripper assembly 100 provides a positioning means and protective structural surrounding for a reciprocating breaker 180, also known as a hammer. Breaker 180 has a replaceable cutting tool 182 extending from one end, beyond gripper assembly 100. A breaker end 184 is located on the end of breaker 180 opposite tool 182.

In FIG. 5, body sections 112 and 114 are illustrated uncoupled. Engagement surfaces 117 are provided on the upper surface of body sections 112 and 114. Engagement surfaces 117 may be comprised of serrations, or teeth, to enhance gripping. Engagement surfaces 117 may be made of wear resistant hardened steel or a wear resistant material. In one embodiment, engagement surfaces 117 are welded to the off-boom edge of body sections 112 and 114.

A pair of reinforcement plates 119 is provided on the outside of each body section 112 and 114. In the embodiment illustrated, reinforcement plates 119 have engagement surfaces 121 on their upper surfaces, extending to the engagement surfaces 117 on body sections 112 and 114. Engagement surfaces 121 may be comprised of serrations, or teeth, which enhance gripping. Engagement surfaces 121 may be made of wear resistant hardened steel or a wear resistant material. In one embodiment, engagement surfaces 117 are welded to the off-boom edge of reinforcement plates 119.

Reinforcement plates 119 act to strengthen gripper assembly 100 so as to resist torque and bending during gripping operations in which large and unbalanced compressive forces are placed on engagement surfaces 117 and 121. Reinforcement plates 119 also protect breaker 180 from destructive contact with bucket 300 during gripping operations.

A hollow bushing 116 may be provided on each of body sections 112 and 114 for forming the pivot connection to bracket 140. A series of aligned holes 118 are provided on body sections 112 and 114 and reinforcement plates 119 for assembly of gripper assembly 100. In the illustrated embodiment, bolt protectors 120 are provided on the exterior of one of the reinforcement plates 119 (shown on the plate nearest to body section 112).

A pair of opposing lower lock plates 122 and a pair of upper lock plates 124 are provided for securing breaker 180 between body sections 112 and 114. Aligned holes 118 are also located on lower lock plates 122 and upper lock plates 124. Lock plates 122 and 124 are secured between breaker 180 and body sections 112 and 114 by nut and bolt assemblies 126 passing through holes 118. In the embodiment, the nuts of nut and bolt assemblies 126 are of the acorn type.

A stop bar 128 is provided for bolted attachment between body sections 112 and 114 at aligned holes 118. A pivot bar 130 is provided for bolted attachment between body sections 112 and 114 at aligned holes 118. Third pivot 106 is comprised of pivot bar 130. A strike 132 is provided for bolted attachment between body sections 112 and 114 at aligned holes 118.

High strength materials may be used to fabricate body sections 112 and 114, lower lock plates 122, upper lock plates 124, nut and bolt assemblies 126, stop bar 128 and pivot bar 130 to strengthen gripper assembly 100 for gripping operations.

Figure 6:
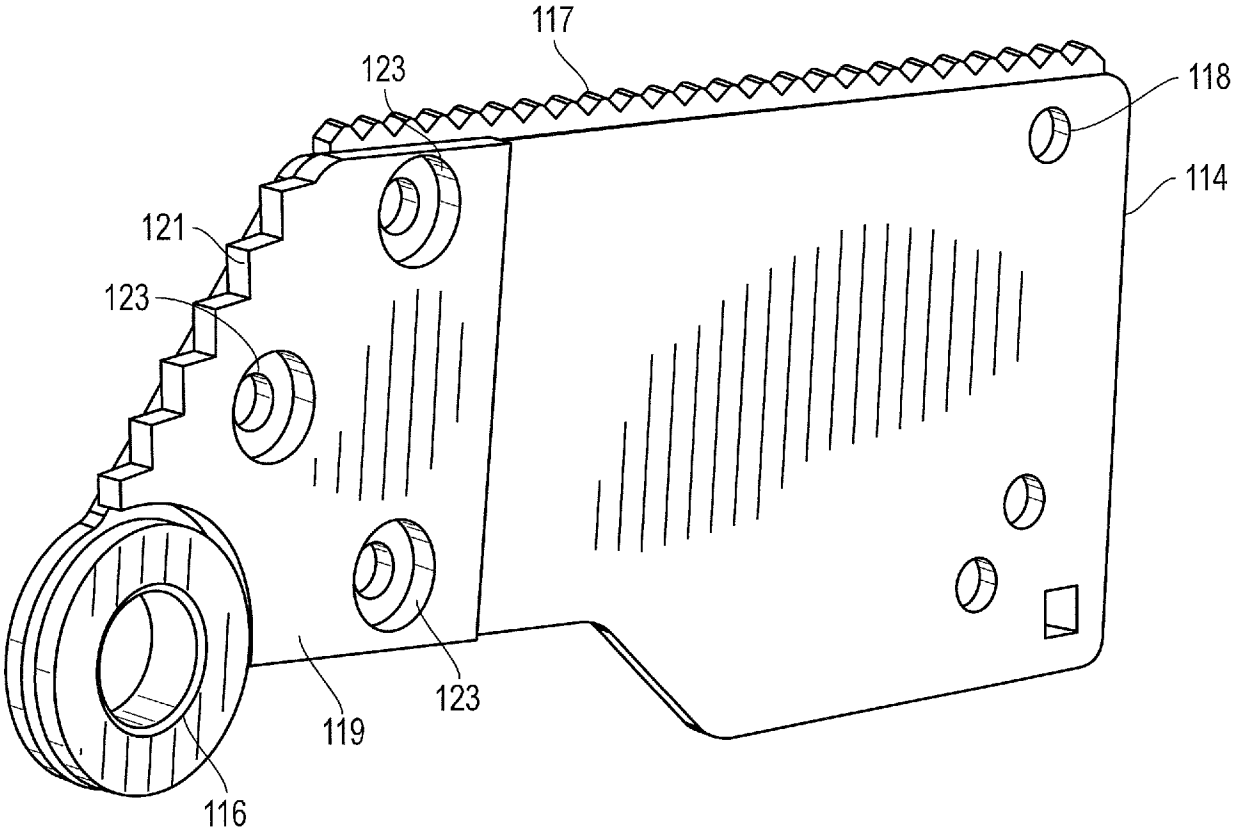
FIG. 6 is an isometric view of one side of the gripper housing in accordance with an embodiment of the invention.

FIG. 6 is an isometric view of an embodiment of body sections 112 and 114 (showing only section 114) and reinforcement plate 119 in detail. In this embodiment, reinforcement plate 119 has counterbore holes 123, which protect the heads of bolts 126 from destruction during gripping operations.

Having thus described the present invention by reference to certain of its embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of the embodiments. Accordingly, it is appropriate that the appended claims be construed broadly and in a manner consistent with the scope of the invention.

The invention claimed is:

1. A boom stick assembly for use on an excavating machine, comprising:

a boom stick having a lower end, a top side, and an underside;

a bucket secured to a lower end of the boom stick for pivotal movement relative thereto;

a gripper pivotally connected to the lower end and underside of the boom stick for pivotal movement relative thereto;

a breaker located inside the gripper and extending outward therefrom;

the bucket being movable between an extended position and a retracted position to perform a digging operation;

the gripper being movable between an extended position and a retracted position to perform a gripping operation in cooperation with the bucket;

the gripper extendable and retractable to position the breaker in relationship to refusal material;

the breaker being hydraulically operable to perform a breaking operation;

a first hydraulic cylinder attached to a topside of the boom stick, and operable to control movement of the bucket independent of the breaker assembly;

a second hydraulic cylinder attached to the underside of the boom stick, and operable to control movement of the gripper independent of the bucket; and, a relief valve and accumulator connected to the second hydraulic cylinder to permit compression of the second cylinder when the second cylinder is subjected to compressive force transferred from the first hydraulic cylinder that exceeds a limit of the relief valve.

2. The boom stick assembly of claim 1, the gripper further comprising:

a mounting plate attachable to an underside of the boom stick;

a latch affixed to the mounting plate;

a housing assembly pivotally connected to the mounting plate;

the housing assembly having a boom side and an off-boom side, and an engagement structure on the off-boom side;

a strike mounted to the boom side of the housing and being engagable with the latch for securing the gripper in a retracted position proximate to the boom stick; and, the hydraulically operable breaker secured inside the housing, and extending beyond the breaker.

3. The boom stick assembly of claim 1, further comprising:

the first and second hydraulic cylinders being operable simultaneously.

4. The boom stick assembly of claim 2, further comprising:

the engagement surface extending to the pivotal connection of the housing to the lower end of the boom stick.

5. The boom stick assembly of claim 2, further comprising:

the engagement surface being made of a wear resistant hardened steel.

6. The boom stick assembly of claim 2, further comprising:

the engagement surface being made of a wear resistant material welded to the off-boom edge of the housing.

7. The boom stick assembly of claim 2, further comprising:

a reinforcement plate connected to the housing; and, a secondary engagement surface on the reinforcement plate.

8. The boom stick assembly of claim 1, further comprising:

retraction of the bucket by force applied by the first cylinder is resisted by an opposing force applied by the second cylinder.

9. The excavating machine of claim 3 wherein the excavating machine is a tracked excavator.

* * * * *